US008224204B2

(12) United States Patent
Köfferlein et al.

(10) Patent No.: US 8,224,204 B2
(45) Date of Patent: Jul. 17, 2012

(54) DEVICE AND METHOD FOR SEALING A SHAFT TO PREVENT THE PENETRATION OF A TONER MIXTURE

(75) Inventors: Florian Köfferlein, München (DE); Mehrad Biglari, München (DE)

(73) Assignee: Oce Printing Systems GmbH, Poing (DE)

( * ) Notice: Subject to any disclaimer, the term of this patent is extended or adjusted under 35 U.S.C. 154(b) by 376 days.

(21) Appl. No.: 12/528,274

(22) PCT Filed: Feb. 18, 2008

(86) PCT No.: PCT/EP2008/051921

§ 371 (c)(1),
(2), (4) Date: Aug. 21, 2009

(87) PCT Pub. No.: WO2008/104469

PCT Pub. Date: Sep. 4, 2008

(65) Prior Publication Data

US 2010/0322663 A1 Dec. 23, 2010

(30) Foreign Application Priority Data

Feb. 26, 2007 (DE) ..... 10 2007 009 190

(51) Int. Cl.
*G03G 15/08* (2006.01)

(52) U.S. Cl. ..... 399/104

(58) Field of Classification Search ..... 399/104
See application file for complete search history.

(56) References Cited

U.S. PATENT DOCUMENTS

| | | | |
|---|---|---|---|
| 5,267,007 | A | 11/1993 | Watanabe et al. |
| 5,450,169 | A | 9/1995 | Hart et al. |
| 5,742,876 | A | 4/1998 | Bogoshian |
| 5,840,773 | A | 11/1998 | Booij et al. |
| 6,295,425 | B1 | 9/2001 | Garcia et al. |
| 2006/0046178 | A1 * | 3/2006 | Akiyama et al. |

FOREIGN PATENT DOCUMENTS

| | | | |
|---|---|---|---|
| DE | 696 27 255 T2 | | 2/1997 |
| JP | 58111066 | | 7/1983 |
| JP | 01142774 A | * | 6/1989 |
| JP | 04254877 A | | 9/1992 |
| JP | 05127464 A | | 5/1993 |

* cited by examiner

*Primary Examiner* — David Gray
*Assistant Examiner* — Laura Roth
(74) *Attorney, Agent, or Firm* — Schiff Hardin LLP

(57) ABSTRACT

In a device or method for sealing a shaft against penetration of a two-component toner mixture comprising magnetic carrier particles and toner particles, an annular, stationary sealing device is arranged radially at a distance of an annular gap around the shaft. The annular gap is charged with a magnetic field. The annular gap is filled with a mixture of a semi-fluid, highly viscous barrier medium and magnetic carrier particles, and wherein the mixture in the annular gap contains 40 to 85 percent by weight or 15 to 60 percent by volume of the magnetic carrier particles.

19 Claims, 4 Drawing Sheets

DEVICE AND METHOD FOR SEALING A SHAFT TO PREVENT THE PENETRATION OF A TONER MIXTURE

BACKGROUND

The preferred embodiment concerns a device for sealing a shaft against the penetration of a toner mixture, in which an annular, stationary sealing device is arranged at a distance of an annular gap around a shaft, and the annular gap is charged with a magnetic field. The preferred embodiment also concerns a method for sealing a shaft against the penetration of a toner mixture.

Rollers (for example magnetic rollers, developer rollers and transport rollers) that respectively comprise a shaft are used in developer stations for electrographic printers or copiers. In a developer station, these shafts can come into contact with a toner mixture comprising magnetic carrier particles and toner particles. The respective shaft is borne in bearings, for example in a slide bearing, ball bearing, radial bearing or roller bearing. If magnetic carrier particles or toner particles enter into this bearing, the bearing can be damaged, with the result that its predetermined service life is not reached and it has to be exchanged early.

A magnetic seal for shafts in a developer station of a printer is known from DE 696 27 225 T2 (corresponding to EP 0 723 211 B1). A magnetic ring that holds the magnetic carrier particles within a magnetic field is used to seal the magnet ring, such that the carrier particles cannot pass through an annular gap between the magnetic ring and a shaft. Different profiled sheets that bundle the magnetic flux so that the sealing effect against the passage of magnetic carrier particles is improved are described in the document.

JP 05 127464 A describes a magnetic bearing to bear a photoconductor roller in an image generating apparatus. The magnetic bearing contains a magnetic fluid which seals the bearing air-tight against the penetration of toner or paper dust.

US-B1-6 377 770 describes a slide bearing for use in a developer station. The slide bearing uses various substances that provide sliding properties and sealing properties.

SUMMARY

It is an object of the invention to specify a device and a method for sealing a shaft against the passage of a toner mixture in which both the passage of the carrier particles and of the toner particles is reliably prevented.

In a device or method for sealing a shaft against penetration of a two-component toner mixture comprising magnetic carrier particles and toner particles, an annular, stationary sealing device is arranged radially at a distance of an annular gap around the shaft. The annular gap is charged with a magnetic field. The annular gap is filled with a mixture of a semi-fluid, highly viscous barrier medium and magnetic carrier particles, and wherein the mixture in the annular gap contains 40 to 85 percent by weight or 15 to 60 percent by volume of the magnetic carrier particles.

DESCRIPTION OF THE PREFERRED EMBODIMENTS

Figure 1:
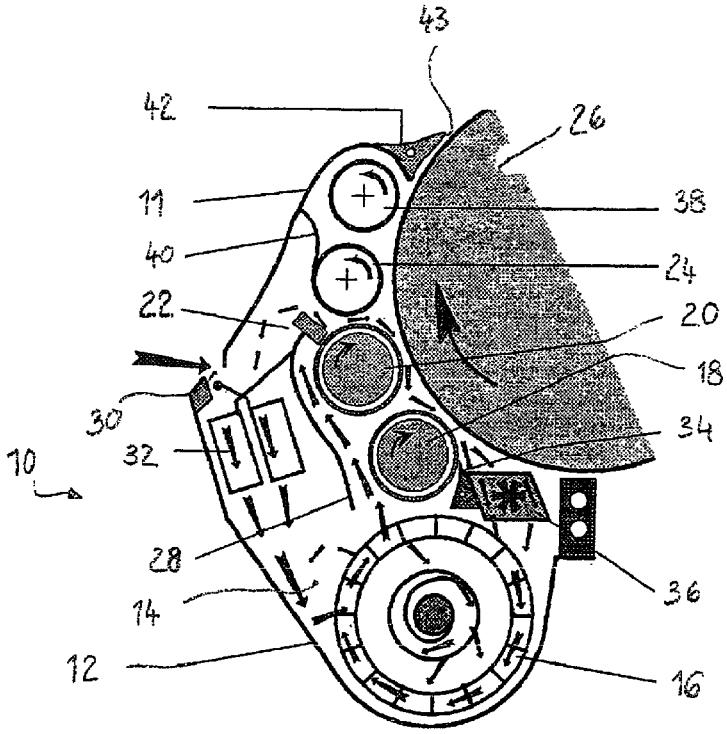
FIG. 1 is an example of a developer of rollers.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

According to a preferred embodiment, the annular gap charged with a magnetic field is filled with a mixture of semi-fluid, highly viscous barrier medium and magnetic carrier particles. Such magnetic carrier particles are also contained in a two-component mixture made up of magnetic carrier particles and toner particles. The magnetic carrier particles align along the magnetic field lines of the magnetic field and thus form a barrier to the passage of the magnetic carrier particles through the annular gap in the axial direction of the shaft. The magnetic forces prevent the magnetic carrier particles from leaving the sealing ring and being able to reach the bearing region of the shaft. Due to the filling with the barrier medium in which the magnetic carrier particles are held in a sufficient mixture, it is additionally prevented that the significantly smaller toner particles can cross the annular gap. This way no toner particles arrive at the bearing and can cause damage there. At the same time, due to the combination of the magnetic carrier particles with the semi-fluid, highly viscous barrier medium, this is likewise held in the region of the annular gap and cannot leave the sealing device. Toner cakes or toner clumps that could lead to print image disruptions, up to failures of the entire developer apparatus, thus cannot form in the region of the seal. Furthermore, the semi-fluid, highly viscous barrier medium acts as a heat sink and heat transfer agent, wherein the heating between the magnetic carrier particles and the shaft or, respectively, the sealing device is reduced.

A barrier medium is to be selected that is largely chemically neutral relative to the toner particles, such that no effect on the toner occurs, in particular no clumping of the toner particles. The barrier medium in particular contains no chemical softener which can chemically dissolve or swell the toner particles (which contain plastic polymers). The barrier medium likewise contains no additives that alter in the toner particles in terms of their mechanical or triboelectrical properties.

In particular, it is provided to use bearing grease which contains lubricant properties as a barrier medium. The lubricating properties reduce the friction in the annular gap and thereby also reduce the warming in this device segment.

According to a further aspect of the preferred embodiment, a method is specified for sealing a shaft against the penetration of a toner mixture. The technical advantages already described further above can be achieved with the aid of this method.

FIG. 1 schematically shows the design of a developer station 10 in which the present preferred embodiment can be used. A housing 11 of the developer station 10 comprises a trough 12 that houses a two-component toner mixture 14 made up of magnetic carrier particles and toner particles. A paddle wheel 16 continuously mixes the magnetic carrier particles and the toner particles that hereby mutually develop a triboelectrical charge and adhere to one another. The two-component toner mixture 14 is caught by a magnetic field of a lower magnetic roller 18 and is transported upward along the shown arrows to a lower magnetic roller 20. The thickness of the mixture carpet made up of carrier particles and toner particles is established via a stripper 22. Furthermore, the two-component toner mixture 14 is pressed through the gap between a dosing roller 24 and the magnetic roller 20 so that the mixture carpet defined by the gap thickness arrives in a developer zone between the developer roller 20 and a photoconductor drum 26. The electrically charged toner particles are drawn from the electrically charged image sections to the photoconductor drum 26 and deposit on the surface of the photoconductor drum 26.

Excess material of the two-component toner mixture is conveyed back into the mixture region of the trough 12 via the stripper 22 and the dosing roller 24 along a baffle plate 28 or additional guide plates. A quantity of fresh toner particles is supplied via an opening 30, is mixed with the already-present two-component toner mixture 14 in a mixing device 32, and arrives in the lower region of the trough 12. A quantity of magnetic carrier particles can also be resupplied as needed via the opening 30.

Following the developer zone, the mixture carpet is conveyed with the aid of a stripper plate 34 from the lower magnetic roller 18 into a mixing device 36 where the carrier particles and the toner particles are stirred transversely in order to compensate for an uneven toner consumption across the width of the photoconductor drum 26. The toner mixture is subsequently taken up again by the paddlewheel 16 and stirred.

A collector drum 38 arranged in the upper region of the developer station has the task of detaching magnetic carrier particles adhering to the photodiode drum 26 and supplying them again to the mixture cycle via a cleaning plate 40. A fine toner dust created due to the movement and stirring of the two-component toner mixture 14 is prevented via suction by a suction device 42 at the exit from a sealing lip 43.

The rollers arranged in the developer station 10, namely paddlewheel 16, magnetic rollers 18, 20, dosing roller 24 and collector roller 38, are arranged on shafts in the housing 11. These shafts are in contact with the two-component toner mixture 14. Their bearings, accommodated by the housing 11, must be protected against the entrance of the toner mixture 14 so that they are not damaged and fail early.

Figure 2:
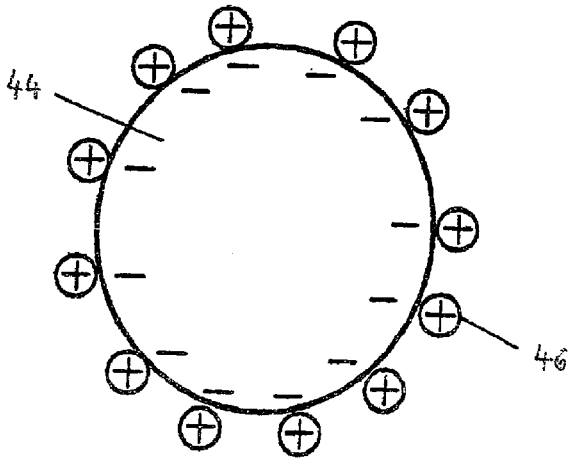
FIG. 2 illustrates schematically, a magnetic carrier particle with toner particles adhering to this.

FIG. 2 schematically shows a magnetic carrier particle 44 to which multiple toner particles 46 electrically adhere. During the stirring of the two-component toner mixture 14, the toner particles 46 are triboelectrically charged by friction. This triboelectrical charging proceeds depending on physical, chemical parameters of the two friction partners. Due to the different electrical charges, the toner particles 46 adhere to the larger carrier particle 44. The carrier particle 44 generally has an irregular or spherical shape and is comprised of magnetic material such as steel or iron. In the present case here, the magnetic carrier particles 44 have an average diameter of 30 to 150 pm, in particular of 40 to 100 μm. The toner particles have an average diameter of 5 to 12 μm, in particular of 6 to 10 μm. The two-component toner mixture contains toner particles 46 in a range of 4 to 12 weight percent (corresponding to 30 to 60 volume percent). The toner particles 46 essentially contain a plastic polymer (PE, epoxy or PEPO base) as well as color pigments.

Figure 3:
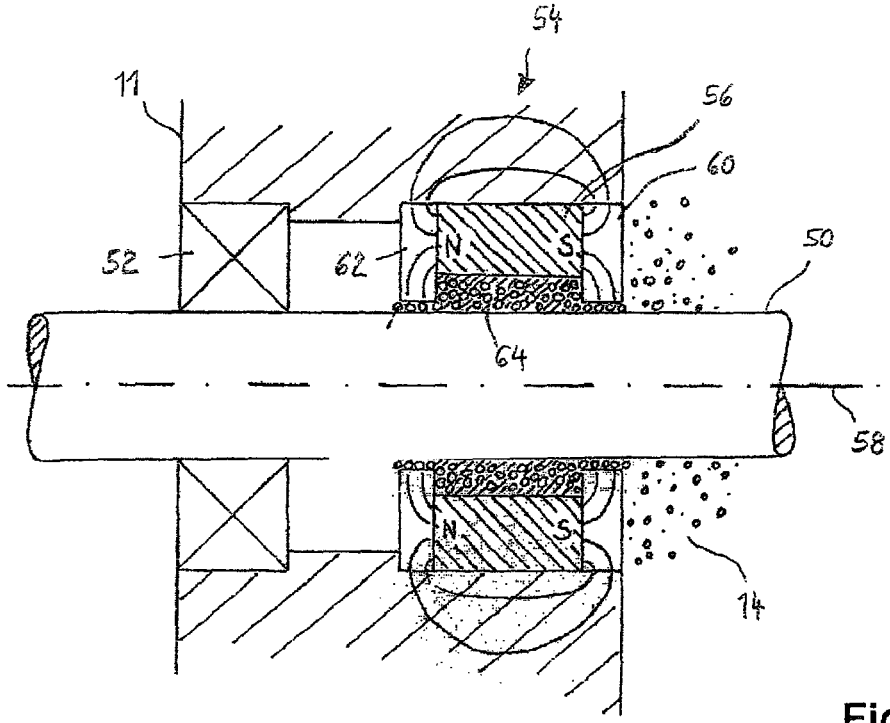
FIG. 3 is a first exemplary embodiment of a sealing device with an annular magnet whose polar axis runs parallel to the shaft axis.

FIG. 3 shows a first exemplary embodiment in which a shaft 50 in a bearing 52 which is accommodated in a housing 11 of the developer station 10 comprises a sealing device 54 that prevents the penetration of the two-component toner mixture to the bearing 52. The sealing device 54 is connected in a stationary manner with the housing 11 and comprises an annular magnet 56 whose polar axis runs parallel to the shaft axis 58. The shaft 50 can be made from weakly magnetic material or from non-magnetic material. The annular magnet 56 generates a magnetic field, indicated by magnetic field lines. This magnetic field is bunched by annular guide plates 60, 62 arranged at the two facing surfaces of the annular magnet 56. The magnetic field is effective in an annular gap formed between shaft 50, guide plates 60, 62 and annular magnet 56. This annular gap 64 is filled with a semi-fluid, highly viscous barrier medium which contains magnetic carrier particles 44. This barrier medium is chemically neutral relative to the toner particles 46 and in particular contains no softeners which could dissolve or swell the plastic polymers of the toner particles 46. Bearing grease which has lubricating properties is advantageously provided as a barrier medium. The barrier medium has a viscosity in the range from 4 to 300 $mm^2/2$, advantageously a viscosity in the range from 10 to 100 $mm^2/s$. The annular gap 64 has a gap width of 0.2 to 1 mm in the range of the conductor plate 60, 62 relative to the surface of the shaft 50. The gap width in the region between the annular magnet 56 and the surface of the shaft 50 is in the range from 0.5 to 5 mm.

The mixture of barrier medium and carrier particles 44 contains magnetic carrier particles in a range from 40 to 85 weight percent or in a range from 15 to 60 volume percent.

The magnetic carrier particles 44 are held in the annular gap 64 (in particular in the region of the guide plates 60, 62) as a result of the intensified magnetic field, even upon rotation of the shaft 50 relative to the annular magnet 56, and do not leave the annular gap 64. The barrier medium (for example bearing grease) surrounding the carrier particles 44 is also held in the annular gap 64 due to the bond with the magnetic carrier particles 44 in the highly viscous, semi-fluid medium. A double effect thus occurs in which on the one hand the carrier particles 44 form a barrier to the penetration of the toner mixture 14 through the annular gap 64, and on the other hand the barrier medium forms a barrier for the toner particles 46 (which are multiple times smaller than the carrier particles 44). The gap width in the annular gap 64, in particular in the region opposite the guide plates 60, 62, may not be chosen too small since otherwise hardly any magnetic carrier particles 44 can accumulate there, and barrier medium can exit from the gap 64. If the width of the gap 64 in this region is selected too large, a closed ring of magnetic carrier particles 44 does not form, and the barrier effect is reduced. An optimal barrier is formed when the width of the gap 64 in the region of the guide plates 60, 62 is 0.2 to 1.0 mm given an average diameter of the magnetic carrier particles from 30 to 150 μm, in particular from 40 to 100 μm.

For example, the barrier medium known under the product name "Isoflex Topas NB 52" from the company Klüber in Germany can be used as a bearing grease.

Figure 4:
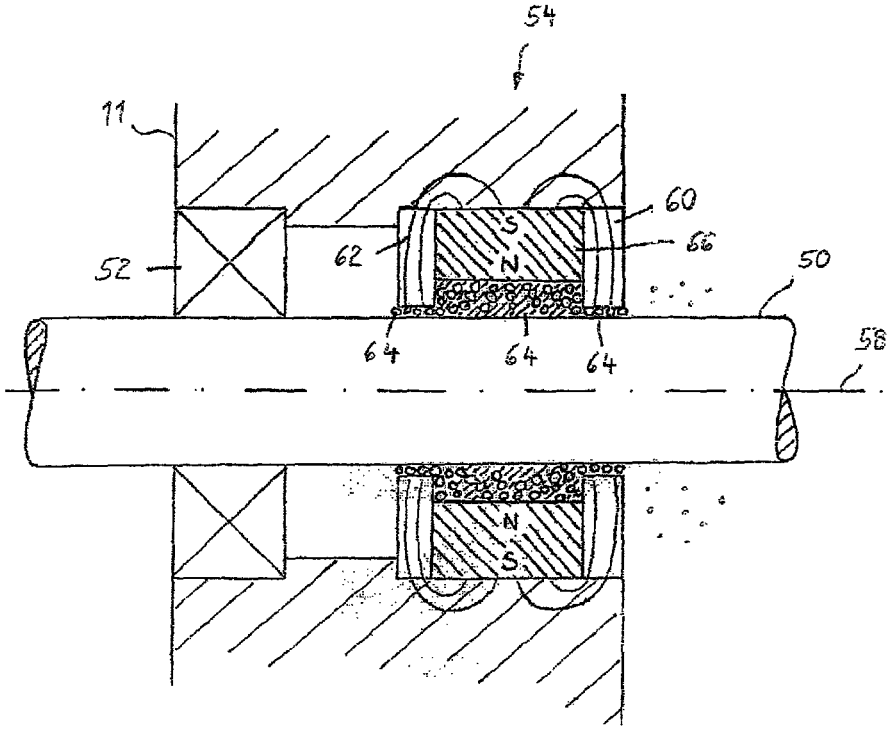
FIG. 4 is an exemplary embodiment with an annular magnet whose polar axis runs in a radial direction relative to the shaft.

FIG. 4 shows an additional exemplary embodiment in which identical parts have the same designation. In contrast to the example according to FIG. 3, the annular magnet 66 has a polar axis that runs in a radial direction relative to the shaft axis 58. In this embodiment, a magnetic field which holds both the magnetic carrier particles 44 and the barrier medium (for example bearing grease) stationary in the annular gap 64 also arises in the region of the guide plates 60, 62, and thus forms an impenetrable barrier for the toner mixture 14.

Figure 5:
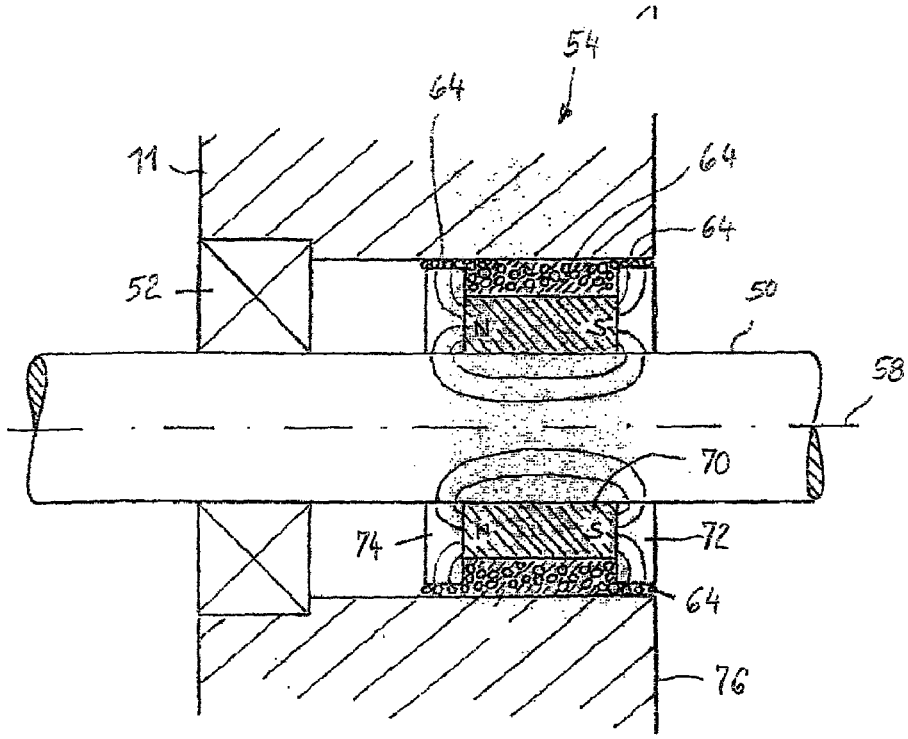
FIG. 5 is an exemplary embodiment in which permanent magnet segments arranged stationary on the shaft are provided.

FIG. 5 shows an exemplary embodiment in which an annular magnet 70 with guide plates 72, 74 are arranged stationary on the shaft 50. The annular gap 64 to be sealed is then formed between a stationary outer ring 76 and the annular magnet 70 and the guide plates 72, 74 that are firmly connected with the shaft 50.

Figure 6:
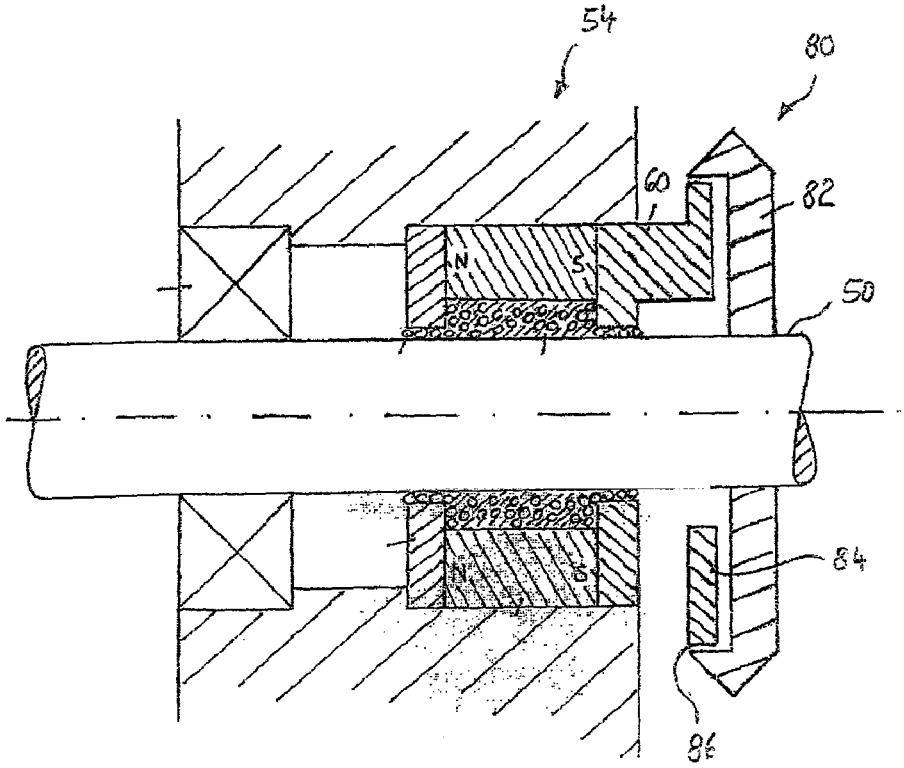
FIG. 6 is an exemplary embodiment with an upstream labyrinth seal.

FIG. 6 shows an embodiment similar to FIG. 3, in which a labyrinth seal 80 is arranged before the bearing 52 and the sealing device 54. This labyrinth seal 80 comprises a baffle plate 82 firmly arranged on the shaft 50, which baffle plate 82 forms an annular gap 86 relative to an inner disc 84.

The inner disc 84 in this example is designed with the front guide plate 60 which is connected in a stationary manner with the housing 11. Due to the narrow annular gap 86, toner mixture 14 can only penetrate to a limited degree, such that the barrier effect of the combination of labyrinth seal 80 and device 54 is even further improved.

Figure 7:
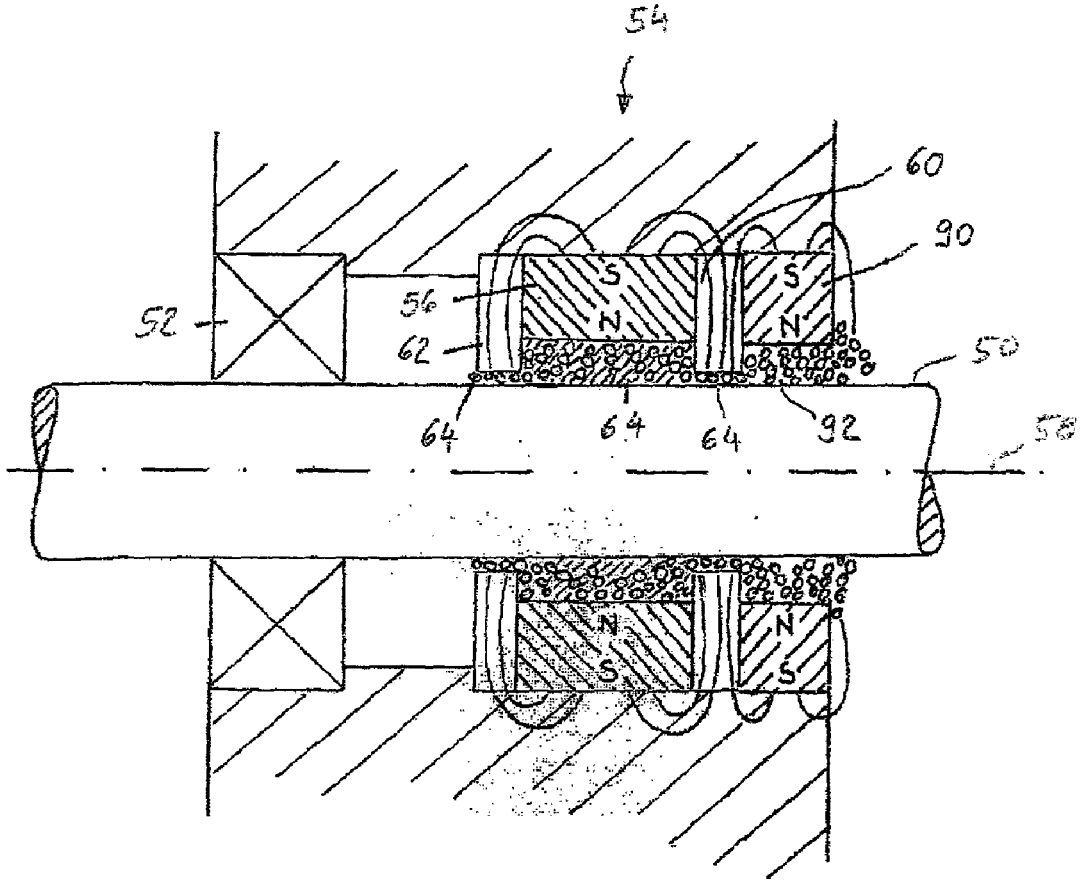
FIG. 7 is an exemplary embodiment with an upstream magnetic seal.

FIG. 7 shows an additional example in which, assuming the embodiment from FIG. 3, an additional annular magnet 90 is arranged upstream as an additional sealing element of the sealing device 54. The annular gap 92 is enlarged here; magnetic carrier particles 44 preferably accumulate in it, which magnetic carrier particles 44 form an annular barrier to the toner mixture so that the barrier effect for this entire device is increased. The different illustrated embodiments can also be combined with one another.

The described exemplary embodiment was described in connection with a developer station. However, the invention can also be used for other shafts that are used in the generation of a two-component toner mixture and its additional processing.

Although preferred exemplary embodiments are shown and described in detail in the drawings and in the preceding specification, these should be viewed merely as an example and not as limiting the invention. It is noted that only the preferred exemplary embodiments are shown and described, and all variations and modifications that presently and in the future lie within the protective scope of the invention should be protected.

The invention claimed is:

1. A device for sealing a shaft against penetration of a two-component toner mixture comprising magnetic carrier particles and toner particles, comprising:

an annular, stationary sealing device arranged radially at a distance of an annular gap around the shaft;

the annular gap being charged with a magnetic field; and the annular gap being filled with a mixture of a semi-fluid, highly viscous barrier medium and magnetic carrier particles which are also contained in said toner mixture wherein the mixture in the annular gap contains 40 to 85 percent by weight or 15 to 60 percent by volume of the magnetic carrier particles, and wherein bearing grease which has lubricating properties is provided as said barrier medium.

2. A device according to claim 1 in which the barrier medium is chemically neutral relative to the toner particles.

3. A device according to claim 1 in which the barrier medium has a viscosity in a range from 3 to 300 mm2/s.

4. A device according to claim 1 in which the sealing device contains permanent magnets that generate the magnetic field in the annular gap.

5. A device according to claim 1 in which an annular magnet whose polar axis runs parallel to an axis of the shaft is provided as a permanent magnet.

6. A device according to claim 1 in which an annular magnet whose polar axis runs in a radial direction relative to the shaft is provided as a permanent magnet.

7. A device according to claim 1 in which the shaft has permanent magnetic segments arranged in a stationary manner, said segments generating the magnetic field in the annular gap.

8. A device according to claim 1 in which the magnetic carrier particles in said mixture filled in said annular gap have an average diameter of 30 to 150 μm.

9. A device according to claim 1 in which the two-component toner mixture toner particles are in a range from 4 to 12 weight percent or 30 to 60 volume percent.

10. A device according to claim 1 in which the annular gap has a reduced entrance gap in an arrival region of the sealing device, a width of the gap width of said entrance gap being in a range from 0.2 to 1.0 mm given an average diameter of the magnetic carrier particles in said mixture filled in said annular gap of 30 to 150 μm.

11. A device according to claim 1 in which annular guide plates that concentrate a magnetic flux in the annular gap are arranged at facing surfaces of the respective annular magnet.

12. A device for sealing a shaft against penetration of a two-component toner mixture comprising magnetic carrier particles and toner particles, comprising:

an annular, stationary sealing device arranged radially at a distance of an annular gap around the shaft;

the annular gap being charged with a magnetic field;

the annular gap being filled with a mixture of a semi-fluid, highly viscous barrier medium and magnetic carrier particles which are also contained in said toner mixture, wherein the mixture in the annular gap contains 40 to 85 percent by weight or 15 to 60 percent by volume of the magnetic carrier particles; and at least one of the entrance gap and an exit gap being formed by a respectively associated guide plate, and wherein the annular gap has a gap width of 0.2 to 1 mm between the guide plates and a surface of the shaft and a gap width of 0.5 to 5 mm between the guide plates and a respective annular magnet.

13. A device for sealing a shaft against penetration of a two-component toner mixture comprising magnetic carrier particles and toner particles, comprising:

an annular, stationary sealing device arranged radially at a distance of an annular gap around the shaft;

the annular gap being charged with a magnetic field;

the annular gap being filled with a mixture of a semi-fluid, highly viscous barrier medium and magnetic carrier particles which are also contained in said toner mixture, wherein the mixture in the annular gap contains 40 to 85 percent by weight or 15 to 60 percent by volume of the magnetic carrier particles; and a labyrinth seal being also arranged on the shaft.

14. A developer station, comprising:

at least one roller that is in contact with a two-component toner mixture made up of magnetic carrier particles and toner particles;

the roller comprising a shaft that is borne on a bearing in a housing, and wherein the shaft comprises a device to seal against penetration of the two-component toner mixture, said device protecting the bearing from entrance of the carrier particles and the toner particles; and said device to seal comprising an annular, stationary sealing device arranged radially at a distance of an annular gap around the shaft, the annular gap being charged with a magnetic field, and the annular gap being filled with a mixture of a semi-fluid, highly viscous barrier medium and magnetic carrier particles which are also contained in said toner mixture, said mixture in the annular gap containing 40 to 85 percent by weight or 15 to 60 percent by volume of the magnetic carrier particles, and wherein bearing grease which has lubricating properties is provided as said barrier medium.

15. A method for sealing a shaft against penetration of a two-component toner mixture made up of magnetic carrier particles and toner particles, comprising the steps of:

providing an annular, stationary sealing device radially at a distance of an annular gap around the shaft and charging the annular gap with a magnetic field; and filling the annular gap with a mixture of a semi-fluid, highly viscous barrier medium and magnetic carrier particles which are also contained in said toner mixture, the mixture in the annular gap containing 40 to 85 percent by weight or 15 to 60 percent by volume of the magnetic carrier particles, and wherein bearing grease which has lubricating properties is provided as said barrier medium.

16. A method according to claim 15 in which the barrier medium is chemically neutral relative to the toner particles.

17. A method according to claim 15 in which the barrier medium has a viscosity in a range from 3 to 300 mm2/s.

18. A method according to claim 15 in which the magnetic carrier particles in said mixture filled in said annular gap have an average diameter of 30 to 150 μm, and the toner particles have an average diameter of 5 to 12 μm.

19. A method according to claim 15 in which the two-component toner mixture toner particles are in a range from 4 to 12 weight percent or 30 to 60 volume percent.

* * * * *